US011005236B2

(12) United States Patent
Gozawa

(10) Patent No.: US 11,005,236 B2
(45) Date of Patent: May 11, 2021

(54) SPARK PLUG

(71) Applicant: NGK SPARK PLUG CO., LTD., Nagoya (JP)

(72) Inventor: Tatsuya Gozawa, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/835,488

(22) Filed: Mar. 31, 2020

(65) Prior Publication Data

US 2020/0358260 A1 Nov. 12, 2020

(30) Foreign Application Priority Data

May 7, 2019 (JP) ..... JP2019-087424

(51) Int. Cl.
*H01T 13/06* (2006.01)
*H01T 13/08* (2006.01)
*H01T 13/20* (2006.01)

(52) U.S. Cl.
CPC ..... *H01T 13/06* (2013.01); *H01T 13/08* (2013.01); *H01T 13/20* (2013.01)

(58) Field of Classification Search
CPC ..... H01T 13/06; H01T 13/08; H01T 13/20
See application file for complete search history.

(56) References Cited

U.S. PATENT DOCUMENTS 8,912,716 B2 12/2014 Hwang et al.
2007/0236122 A1* 10/2007 Borror ..... H01T 13/54 313/118
2012/0242215 A1* 9/2012 Hwang ..... H01T 13/54 313/143

FOREIGN PATENT DOCUMENTS

DE 102016206992 A1 * 10/2017 ..... H01T 13/32
DE 102018206784 A1 * 11/2019 ..... H01T 13/16
JP 2012-199236 A 10/2012
JP 2016-035854 A 3/2016

OTHER PUBLICATIONS

DE-102016206992-A1 English Machine translation retrieved from Esp@cenet (Year: 2017).*
Office Action issued in corresponding Japanese Patent Application No. 2019-087424 dated Mar. 24, 2021 (English-language machine translation provided.

* cited by examiner

*Primary Examiner* — Mariceli Santiago
(74) *Attorney, Agent, or Firm* — Kusner & Jaffe

(57) ABSTRACT

A spark plug wherein the occurrence of cracks at a joint portion between a cover portion and a metal shell in the spark plug is prevented. The spark plug includes a cylindrical metal shell that accommodates an insulator therein, and a cover portion that covers, from a front end side of the spark plug, a front end portion of a center electrode and a facing portion of a ground electrode to form a pre-chamber space. The cover portion is joined to a front end side of the metal shell and has injection holes that are through-holes. A first coefficient of thermal expansion A ($10^{-5}$/K) of the material forming the cover portion at normal temperature and a second coefficient of thermal expansion B ($10^{-5}$/K) of the metal shell at normal temperature satisfy a formula (1): A<B.

4 Claims, 2 Drawing Sheets

SPARK PLUG

FIELD OF THE INVENTION

The present invention relates to a spark plug.

BACKGROUND OF THE INVENTION

Description of the Related Art

Spark plugs including an ignition chamber have been developed. For example, a pre-chamber ignition plug according to Japanese Unexamined Patent Application Publication No. 2012-199236 ("PTL 1") includes a cylindrical metal housing, and an ignition chamber cap that surrounds a center electrode and a ground electrode to form an ignition chamber. The ignition chamber cap has multiple orifices that allow an air-fuel mixture to flow into the ignition chamber from a combustion chamber. This ignition plug ignites in the ignition chamber, and injects torch-shaped flames into the combustion chamber through the orifices to burn an air-fuel mixture in the combustion chamber.

The ignition plug disclosed in PTL 1, however, has a structure where the ignition chamber is closed except for the orifices. Thus, the temperature inside the ignition chamber tends to rise at the ignition. Particularly, the temperature inside the ignition chamber tends to be high toward the front end side of the spark plug. A joint portion between the ignition chamber cap and the housing is joined by welding, and therefore, thermal stress may be generated at the joint portion in response to an occurrence of a thermal cycle. The thermal stress increases further as the thermal gradient increases, and tends to cause occurrence of cracks.

SUMMARY OF THE INVENTION

The present invention has been made in view of the above-described circumstances, and aims to prevent occurrence of cracks at a joint portion between the cover portion and a metal shell in a spark plug including a cover portion that forms a pre-chamber. The present invention can be embodied in the following forms.

(1) A spark plug includes a center electrode, a ground electrode that includes a facing portion facing a front end portion of the center electrode and forms a discharge gap between the facing portion and the front end portion of the center electrode, a cylindrical insulator that accommodates the center electrode therein with the front end portion of the center electrode being exposed from a front end of the insulator, a cylindrical metal shell that accommodates the insulator therein, and a cover portion that covers, from a front end side of the spark plug, the front end portion of the center electrode and the facing portion of the ground electrode to form a pre-chamber, the cover portion being joined to a front end side of the metal shell and including an injection hole that is a through-hole. A first coefficient of thermal expansion A ($10^{-5}$/K) of a material forming the cover portion at normal temperature and a second coefficient of thermal expansion B ($10^{-5}$/K) of the metal shell at normal temperature satisfy a formula (1):

$$A<B \qquad \text{formula (1).}$$

The spark plug according to an aspect of the present invention employs a structure satisfying a relationship of A<B where A is a first coefficient of thermal expansion ($10^{-5}$/K) of a material forming the cover portion at normal temperature and B is a second coefficient of thermal expansion B ($10^{-5}$/K) of the metal shell at normal temperature. Thus, the spark plug can reduce thermal stress generated at the joint portion between the metal shell and the cover portion, and prevent occurrence of cracks at the joint portion.

(2) In a spark plug described in (1), the first coefficient of thermal expansion A ($10^{-5}$/K) and the second coefficient of thermal expansion B ($10^{-5}$/K) satisfy a formula (2):

$$0.84<A/B<1.00 \qquad \text{formula (2).}$$

The spark plug according to an aspect of the present invention employs a structure satisfying a relationship of 0.84<A/B<1.00 where A is a first coefficient of thermal expansion ($10^{-5}$/K) of a material forming the cover portion at normal temperature and B is a second coefficient of thermal expansion ($10^{-5}$/K) of the metal shell at normal temperature. This structure can reduce a difference in stress caused by the difference between the degree of thermal expansion of the cover portion and the degree of thermal expansion of the metal shell, thereby reducing thermal stress generated between the cover portion and the metal shell, and prevent occurrence of cracks.

(3) In the spark plug according to (1) or (2), the ground electrode is connected to the metal shell, and the metal shell includes, at a front end side of the metal shell, a screw portion configured to be screwed to a combustion chamber. A joint portion between the cover portion and the metal shell is located on the front end side of the spark plug with respect to the ground electrode.

In the spark plug, the metal shell is screwed to the combustion chamber via the screw portion, which allows heat generated at the front end side of the metal shell to escape toward the combustion chamber side via the screw portion. The ground electrode is located on the rear end side with respect to the joint portion between the cover portion and the metal shell, and thus located near the screw portion, which allows heat generated near the discharge gap to escape from the ground electrode toward the combustion chamber side via the screw portion of the metal shell.

DETAILED DESCRIPTION OF THE INVENTION

First Embodiment

Hereinafter, a first embodiment of a spark plug 100 will be described in detail with reference to the drawings. In the following description, the lower side in FIG. 1 is referred to as a front end side (front side) of the spark plug 100, and the upper side in FIG. 1 is referred to as a rear end side of the spark plug 100.

Figure 1:
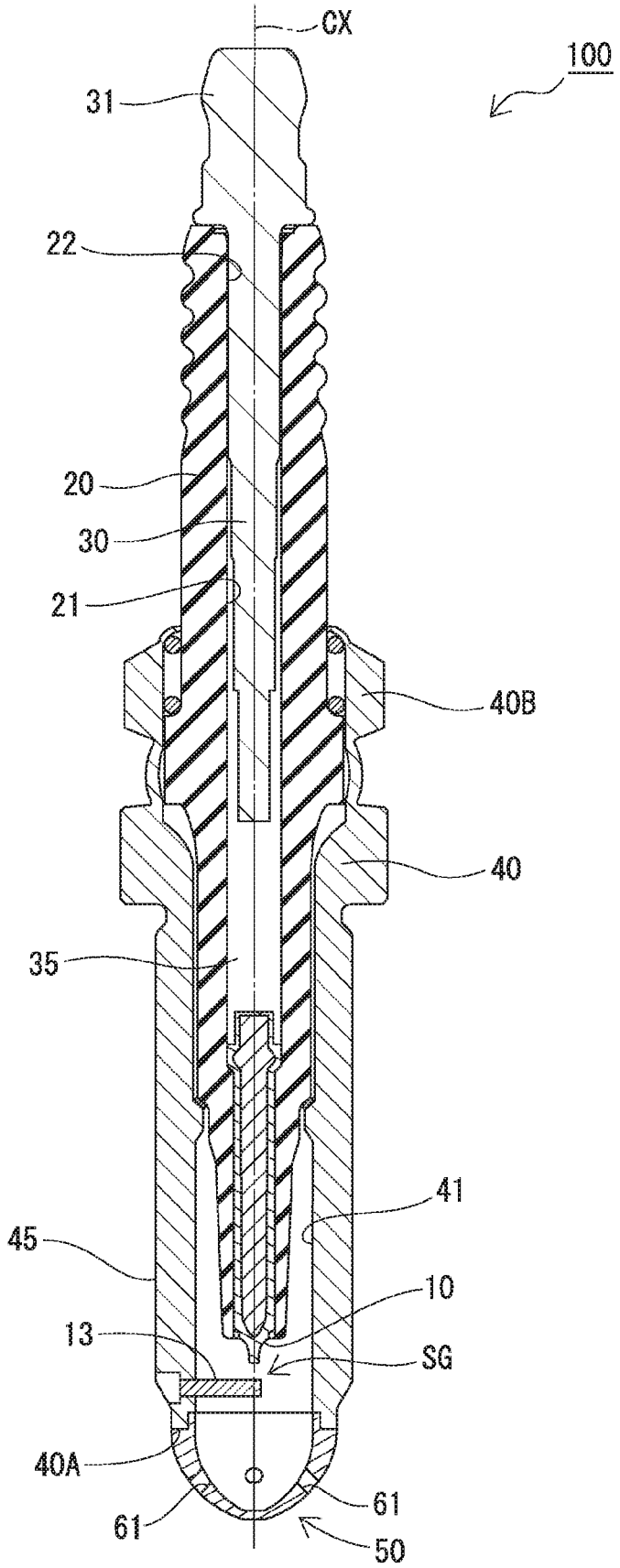
FIG. 1 is a cross-sectional view of a structure of a spark plug according to a first embodiment.

FIG. 1 is a cross-sectional view of a schematic structure of the spark plug 100 according to the first embodiment. In FIG. 1, a center axial line CX of the spark plug 100 (an axial line of the spark plug) is drawn with a dot-and-dash line.

The spark plug 100 is mounted on an internal combustion engine and used to ignite an air-fuel mixture in a combustion chamber. When mounted on the internal combustion engine, the front end side of the spark plug 100 (lower side in the drawing) is disposed inside the combustion chamber of the internal combustion engine, and the rear end side (upper side in the drawing) is disposed outside the combustion chamber. The spark plug 100 includes a center electrode 10, a ground electrode 13, an insulator 20, a terminal electrode 30, and a metal shell 40.

The center electrode 10 is constituted by a shaft-shaped electrode member and disposed in such a manner that a center axis thereof is coincident with the center axial line CX of the spark plug 100. The center electrode 10 is held by the metal shell 40 with the insulator 20 interposed therebetween in such a manner that a front end portion 11 is positioned on the rear end side (upper side in the drawing) with respect to a front-end-side opening portion 40A of the metal shell 40. The center electrode 10 is electrically connected to an external power source via the terminal electrode 30 disposed on the rear end side.

Figure 2:
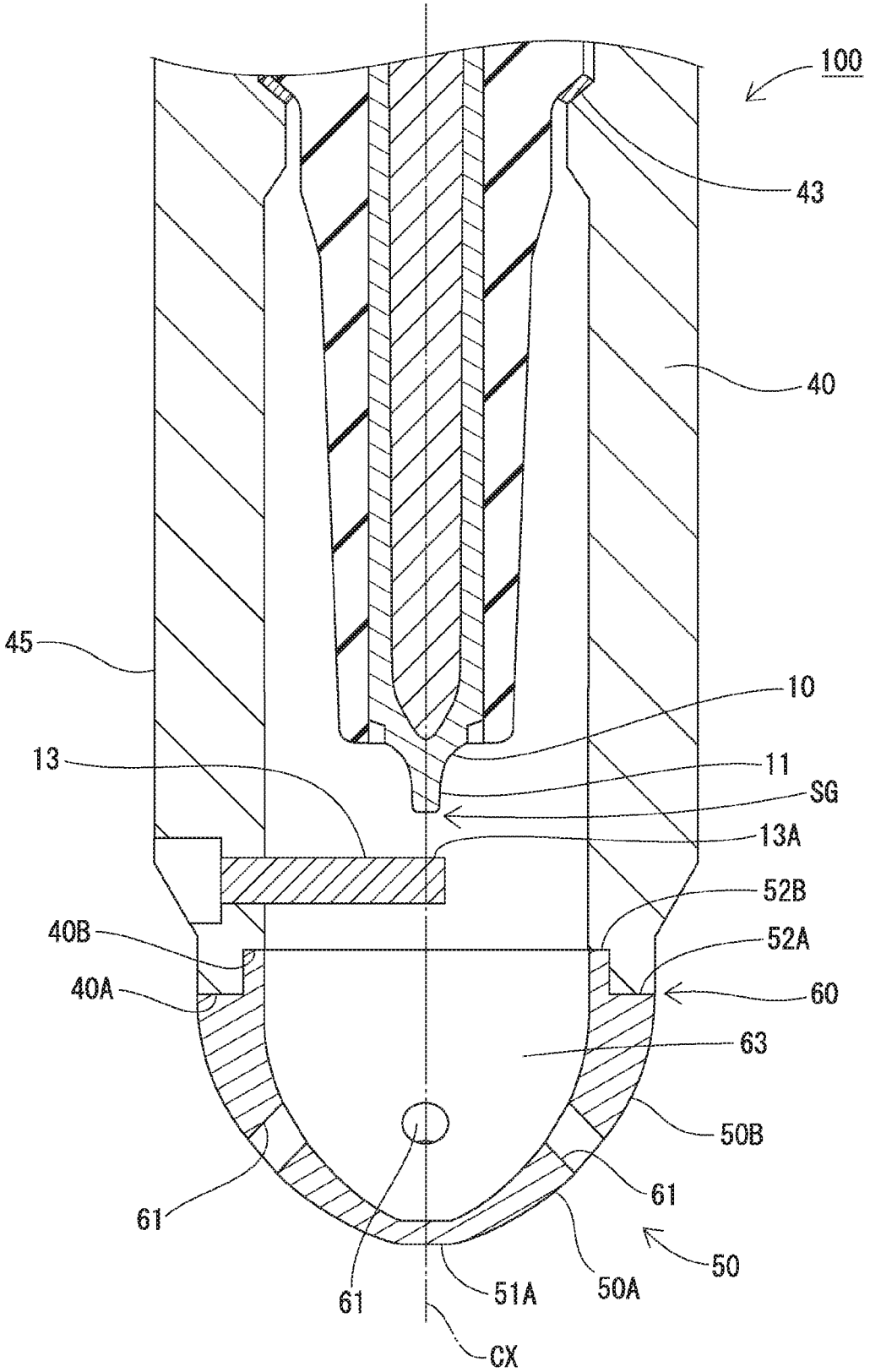
FIG. 2 is a partially enlarged cross-sectional view of the spark plug according to a first embodiment.

The ground electrode 13 is a rod-shaped electrode extending from a position slightly on the rear end side (upper side in the drawing) with respect to the front-end-side opening portion 40A of the metal shell 40 toward a position slightly on the front end side (lower side in the drawing) with respect to the front end portion 11 of the center electrode 10. Specifically, the ground electrode 13 is connected to the metal shell 40 at a position slightly on the rear end side (upper side in the drawing) with respect to the front-end-side opening portion 40A. The ground electrode 13 extends up to the front of the front end portion 11 of the center electrode 10. As illustrated in FIG. 2, the ground electrode 13 includes a facing portion 13A facing the front end portion 11 of the center electrode 10. A discharge gap SG is formed between the facing portion 13A of the ground electrode 13 and the front end portion 11 of the center electrode 10.

The insulator 20 is a cylindrical member including an axial hole 21 penetrating through the center thereof. The insulator 20 is constituted by, for example, a ceramic sintered body made of alumina or aluminum nitride. On the front end side of the axial hole 21 of the insulator 20, the center electrode 10 is accommodated with the front end portion 11 thereof being exposed. On the rear end side of the axial hole 21, the terminal electrode 30, which is a shaft-shaped electrode member, is held. A rear end portion 31 of the terminal electrode 30 extends out from a rear end opening portion 22 of the insulator 20 so as to be connectable with the external power source. The center electrode 10 and the terminal electrode 30 are electrically connected to each other via a resistor 35 that is held between glass sealing materials in order to suppress generation of radio interference noise when a spark discharge occurs. The center axis of the insulator 20 is coincident with the center axial line CX of the spark plug 100.

The metal shell 40 is a substantially cylindrical metal member including a cylinder hole 41 at the center thereof. The metal shell 40 is constituted of, for example, low-carbon steel or a copper-based alloy. The center axis of the metal shell 40 is coincident with the center axial line CX of the spark plug 100. As described above, the ground electrode 13 is attached near the front-end-side opening portion 40A of the metal shell 40. As illustrated in FIG. 2, the front-end-side opening 40A of the metal shell 40 has a recess 40B that is recessed from the inner edge portion toward the rear end side. A packing 43 is disposed between a diameter reduced portion inside the metal shell 40 and the insulator 20. The packing 43 is constituted by, for example, a metal material softer than a metal material constituting the metal shell 40. The metal shell 40 includes, at its front end side, a screw portion 45 configured to be screwed to the combustion chamber. The screw portion 45 is constituted by a helical screw thread extending from the front end side to the rear end side of the metal shell 40.

The spark plug 100 includes a cover portion 50. The cover portion 50 has a dome shape. The cover portion 50 is constituted of, for example, stainless steel, nickel-based alloy, or copper-based alloy. The cover portion 50 is annularly joined to the front end of the metal shell 40. A joint portion 60 between the cover portion 50 and the metal shell 40 is formed by a known welding method (such as laser welding). The joint portion 60 between the cover portion 50 and the metal shell 40 is located on the front end side of the spark plug 100 with respect to the ground electrode 13. As illustrated in FIG. 2, a rear-end-side opening 52A of the cover portion 50 is joined to the front-end-side opening 40A of the metal shell 40. The rear-end-side opening 52A of the cover portion 50 includes a protrusion 52B protruding from the inner edge portion toward the rear end side. The protrusion 52B of the cover portion 50 is fitted into the recess 40B of the metal shell 40. Thus, when the cover portion 50 thermally expands, the cover portion 50 expands in a direction in which the protrusion 52B fits into the recess 40B. Thus, the joint portion between the cover portion 50 and the metal shell 40 is less easily separated.

The cover portion 50 covers the front end portion 11 of the center electrode 10 and the facing portion 13A of the ground electrode 13 from the front side. The space surrounded by the cover portion 50 is a pre-chamber space (pre-chamber) 63. The cover portion 50 has its thickness gradually decreasing from the rear end side toward an apex 51A.

As illustrated in FIG. 2, the cover portion 50 has multiple injection holes 61 on the rear end side of the apex 51A. The cover portion 50 has, for example, four injection holes 61. Each of the injection holes 61 is a substantially cylindrical through-hole. Each of the injection holes 61 has its center axial line AX inclined with respect to the center axial line CX of the spark plug 100. The multiple injection holes 61 are positioned on a virtual circumference centered on the center axial line CX of the spark plug 100. The multiple injection holes 61 are arranged at equal intervals on the virtual circumference. The pre-chamber space 63, which is a space covered with the cover portion 50, functions as an ignition chamber, and communicates with the combustion chamber via the injection holes 61.

In the spark plug 100 according to the first embodiment, a first coefficient of thermal expansion A ($10^{-5}$/K) of the material forming the cover portion 50 at normal temperature and a second coefficient of thermal expansion B ($10^{-5}$/K) of the metal shell 40 at normal temperature satisfy formulas (1), (3) and (4) below:

$$A<B \quad \text{formula (1);}$$

$$1.04 \leq A \leq 1.77 \quad \text{formula (3); and}$$

$$1.22 \leq B \leq 1.78 \quad \text{formula (4).}$$

This spark plug 100 employs a structure satisfying a relationship of A<B where A is the first coefficient of thermal expansion ($10^{-5}$/K) of the material forming the cover portion 50 at normal temperature and B is the second coefficient of thermal expansion ($10^{-5}$/K) of the metal shell 40 at normal temperature. Thus, the spark plug 100 can reduce thermal stress generated at the joint portion 60 between the metal shell 40 and the cover portion 50, and prevent occurrence of cracks at the joint portion 60.

In the spark plug 100 according to the first embodiment, the first coefficient of thermal expansion A ($10^{-5}$/K) and the second coefficient of thermal expansion B ($10^{-5}$/K) satisfy a formula (2), below:

$$0.84 < A/B < 1.00 \quad \text{formula (2).}$$

The spark plug 100 employs a structure satisfying a relationship of 0.84<A/B<1.00 where A is the first coefficient of thermal expansion ($10^{-5}$/K) of the material forming the cover portion 50 at normal temperature and B is the second coefficient of thermal expansion ($10^{-5}$/K) of the metal shell 40 at normal temperature. This structure can reduce a difference in stress caused by a difference between the degree of thermal expansion of the cover portion 50 and the degree of thermal expansion of the metal shell 40, thereby reducing thermal stress caused between the cover portion 50 and the metal shell 40, and prevent occurrence of cracks at the joint portion 60.

In the spark plug 100 according to the first embodiment, the ground electrode 13 is connected to the metal shell 40. The metal shell 40 includes, at its front end side, the screw portion 45 configured to be screwed to the combustion chamber. The joint portion 60 between the cover portion 50 and the metal shell 40 is located on the front end side of the spark plug 100 with respect to the ground electrode 13.

In the spark plug 100, the metal shell 40 is screwed to the combustion chamber via the screw portion 45, which allows heat generated at the front end side of the metal shell 40 to escape toward the combustion chamber via the screw portion 45. The ground electrode 13 is located on the rear end side with respect to the joint portion 60 between the cover portion 50 and the metal shell 40, and thus located near the screw portion 45, which allows heat generated near the discharge gap SG to escape from the ground electrode 13 toward the combustion chamber side via the screw portion 45 of the metal shell 40.

EXAMPLES

The present invention will be more specifically described below using examples.

1. Experiment (Experiment Corresponding to First Embodiment)

(1) Method of Experiment

(1.1) Examples

Samples of the spark plug 100 illustrated in FIGS. 1 and 2 were used herein. Table 1, below, shows the detailed conditions. The spark plug 100 satisfies the requirements of the first embodiment. In Table 1, each experiment example is denoted with "No.". Nos. 3 to 6, 9, 10, and 12 to 18 in Table 1 are examples.

(1.2) Comparative Examples

Samples of a spark plug having a structure different from that of the spark plug 100 illustrated in FIGS. 1 and 2 were used herein. Table 1, below, shows the detailed conditions. This spark plug does not satisfy the requirements of the first embodiment. Numbers marked with an asterisk "*", like "1*" in Table 1, denote that they are comparative examples. Specifically, Nos. 1, 2, 7, 8, and 11 in Table 1 are comparative examples.

(2) Method for Evaluation

(2.1) Anti-Peeling Performance Evaluation Test

Each sample underwent an anti-peeling performance evaluation test. The summary of the anti-peeling performance evaluation test is as follows. Each sample was mounted on a naturally aspirated engine with a displacement of 1.3 L, and the engine underwent, for the total of 100 hours, a thermal cycle durability test in which the engine was controlled to be alternately operated on full throttle (6000 rpm) bearing a high load, and in an idling state bearing a low load, for 60 seconds each. Each sample that underwent the thermal cycle durability test was embedded in resin, and a half section (cross section of one side of a plane passing the center axial line CX of the spark plug 100) of the joint portion between the cover portion and the metal shell was observed with an optical microscope. The length of the joint portion and the length of an oxide scale along the cross section were measured by observing the half section with the optical microscope. An oxide scale is not generated in a portion where the joint is retained, and an oxide scale is generated in a portion where peeling is caused, thus the portion where the joint is retained and the portion where peeling is caused can be specified. In the half section, the rate of the length of the portion where peeling was caused to the entire length of the joint portion between the cover portion and the metal shell (peeling rate) was calculated.

<Evaluation of Anti-Peeling Performance>

Each sample was evaluated with the following three grades. The results are shown in the column "anti-peeling performance" in Table 1.

Evaluation:

Excellent: Peeling rate of lower than 10%

Good: Peeling rate of 10% or higher and lower than 50%

Poor: Peeling rate of 50% or higher

TABLE 1

| No. | A: First coefficient of thermal expansion of cover portion ($10^{-5}$/K) | B: Second coefficient of thermal expansion of metal shell ($10^{-5}$/K) | A/B | Anti-peeling performance |
|---|---|---|---|---|
| 1* | 1.22 | 1.22 | 1.00 | Poor |
| 2* | 1.78 | 1.22 | 1.46 | Poor |
| 3 | 1.04 | 1.22 | 0.85 | Excellent |
| 4 | 1.11 | 1.22 | 0.91 | Excellent |
| 5 | 1.10 | 1.22 | 0.90 | Excellent |
| 6 | 1.10 | 1.22 | 0.90 | Excellent |
| 7* | 1.33 | 1.22 | 1.09 | Poor |
| 8* | 1.77 | 1.22 | 1.45 | Poor |
| 9 | 1.15 | 1.22 | 0.94 | Excellent |
| 10 | 1.22 | 1.78 | 0.68 | Good |
| 11* | 1.78 | 1.78 | 1.00 | Poor |
| 12 | 1.04 | 1.78 | 0.58 | Good |
| 13 | 1.11 | 1.78 | 0.62 | Good |
| 14 | 1.10 | 1.78 | 0.62 | Good |
| 15 | 1.10 | 1.78 | 0.62 | Good |
| 16 | 1.33 | 1.78 | 0.75 | Good |
| 17 | 1.77 | 1.78 | 0.99 | Excellent |
| 18 | 1.15 | 1.78 | 0.65 | Good |

(3) Evaluation Result

The experiment example 1 (comparative example) was rated poor in "anti-peeling performance", with a ratio AB of 1.00, where A denotes the first coefficient of thermal expansion ($10^{-5}$/K) of the material forming the cover portion at normal temperature and B denotes the second coefficient of thermal expansion ($10^{-5}$/K) of the metal shell at normal temperature. The experiment examples 2, 7, 8, and 11 (comparative examples) were rated poor in "anti-peeling performance" with A/B of 1.46, 1.09, 1.45, and 1.00, respectively. On the other hands, the experiment examples 3 to 6, 9, 10, and 12 to 18 (examples) were rated excellent or good in "anti-peeling performance" with A/B<1, that is, A<B. Thus, the examples satisfying the above formula 1 (A<B) suppressed peeling at the joint portion 60 between the cover portion 50 and the metal shell 40 as compared with the comparative examples.

The experiment examples 10, 12 to 16, and 18 (examples) were rated good in "anti-peeling performance" with A/B of 0.68, 0.58, 0.62, 0.62, 0.62, 0.75, and 0.65, respectively. On the other hand, the experiment examples 3 to 6, 9, and 17 (examples) were rated excellent in "anti-peeling performance" with 0.84<A/B<1.00. Thus, the examples satisfying the formula (2) (0.84<A/B<1.00) further suppressed peeling at the joint portion 60 between the cover portion 50 and the metal shell 40.

Other Embodiments (Modifications)

The present invention is not limited to the above embodiments, and may be embodied in various different forms within the scope not departing from the gist of the invention.

(1) In the above embodiments, the cover portion has a specific shape, but the shape is changeable as appropriate. The cover portion may have, for example, a circular cylindrical shape, a quadrangular box shape, or a conical shape.

(2) In the above embodiments, a spark plug having a specific number of injection holes is described as an example, but the number of injection holes is not limited to a specific one and changeable as appropriate. The arrangement of the injection holes and the penetrating direction of the injection hole are also changeable as appropriate.

What is claimed is:

1. A spark plug, comprising:

a center electrode;

a ground electrode that includes a facing portion facing a front end portion of the center electrode and forms a discharge gap between the facing portion and the front end portion of the center electrode;

a cylindrical insulator that accommodates the center electrode therein with the front end portion of the center electrode being exposed from a front end of the insulator;

a cylindrical metal shell that accommodates the insulator therein; and a cover portion that covers, from a front end side of the spark plug, the front end portion of the center electrode and the facing portion of the ground electrode to form a pre-chamber, the cover portion being joined to a front end side of the metal shell and including an injection hole that is a through-hole, wherein a first coefficient of thermal expansion A ($10^{-5}$/K) of a material forming the cover portion at normal temperature and a second coefficient of thermal expansion B ($10^{-5}$/K) of the metal shell at normal temperature satisfy a formula (1):

$$A<B.$$

2. The spark plug according to claim 1, wherein the first coefficient of thermal expansion A ($10^{-5}$/K) and the second coefficient of thermal expansion B ($10^{-5}$/K) satisfy a formula (2):

$$0.84<A/B<1.00.$$

3. The spark plug according to claim 1, wherein the ground electrode is connected to the metal shell, wherein the metal shell includes, at a front end side of the metal shell, a screw portion configured to be screwed to a combustion chamber, and wherein a joint portion between the cover portion and the metal shell is located on the front end side of the spark plug with respect to the ground electrode.

4. The spark plug according to claim 2, wherein the ground electrode is connected to the metal shell, wherein the metal shell includes, at a front end side of the metal shell, a screw portion configured to be screwed to a combustion chamber, and wherein a joint portion between the cover portion and the metal shell is located on the front end side of the spark plug with respect to the ground electrode.

* * * * *